US006168012B1

(12) United States Patent
Galbierz

(10) Patent No.: US 6,168,012 B1
(45) Date of Patent: Jan. 2, 2001

(54) BOTTLE CARRIER

(75) Inventor: Michael A. Galbierz, St. Louis, MO (US)

(73) Assignee: Eco-Pak Products, Inc., Fenton, MO (US)

( * ) Notice: Under 35 U.S.C. 154(b), the term of this patent shall be extended for 0 days.

(21) Appl. No.: 09/325,255

(22) Filed: Jun. 3, 1999

(51) Int. Cl.[7] ..... B65D 75/00
(52) U.S. Cl. ..... 206/153; 206/151; 206/158
(58) Field of Search ..... 206/148, 151, 206/152, 153, 158, 139, 145, 147, 149, 155, 427, 434

(56) References Cited

U.S. PATENT DOCUMENTS

| | | | | |
|---|---|---|---|---|
| 2,654,474 | * | 10/1953 | Ringler | 206/158 |
| 3,038,600 | | 6/1962 | Powell . | |
| 3,137,109 | | 6/1964 | Rapata . | |
| 3,156,358 | | 11/1964 | Randrup . | |
| 3,317,234 | | 5/1967 | Burgford . | |
| 3,528,697 | | 9/1970 | Wood . | |
| 4,378,878 | | 4/1983 | Graser . | |
| 4,378,879 | | 4/1983 | Killy . | |
| 4,432,579 | | 2/1984 | Denmark . | |
| 4,621,734 | | 11/1986 | Heijnen et al. . | |
| 4,736,977 | | 4/1988 | Killy . | |
| 5,022,525 | * | 6/1991 | Schuster | 206/158 |
| 5,103,971 | * | 4/1992 | Schuster | 206/153 |
| 5,320,216 | * | 6/1994 | Pangborn | 206/158 |
| 5,323,895 | | 6/1994 | Sutherland et al. . | |
| 5,328,024 | | 7/1994 | Sutherland . | |
| 5,445,262 | * | 8/1995 | Sutherland | 206/148 |
| 5,485,914 | | 1/1996 | Martin . | |
| 5,487,463 | | 1/1996 | Harris . | |
| 5,487,464 | * | 1/1996 | Galbierz et al. | 206/158 |
| 5,551,566 | * | 9/1996 | Sutterland | 206/427 |
| 5,573,111 | * | 11/1996 | Gordon et al. | 206/151 |
| 5,590,776 | * | 1/1997 | Galbierz | 206/153 |
| 5,639,137 | * | 6/1997 | Bakx | 206/158 |
| 5,816,391 | * | 10/1998 | Harris | 206/139 |
| 5,845,776 | * | 12/1998 | Galbierz et al. | 206/427 |
| 5,878,876 | * | 3/1999 | Galbierz et al. | 206/158 |

* cited by examiner

*Primary Examiner*—David T. Fidei
(74) *Attorney, Agent, or Firm*—Polster, Lieder Woodruff & Lucchesi

(57) ABSTRACT

A paperboard carrier is provided. The carrier includes a two ply top panel, side walls, and a bottom panel. Apertures in the top and bottom panels allow for the carrier to be applied to a set of bottles. Tabs are formed in the top panel to support the bottles in the carrier. The carrier is provided with many different features, including a tongue which extends upwardly from the edge of the bottom panel apertures. The tongues engage the underside of the top panel to help prevent racking of the carrier relative to the bottles and to help space the top and bottom panels apart. The base of the tabs in the top panel top ply define a circle greater in diameter than the top panel bottom ply apertures, and the tabs engage the bottle at an angle of less than 45°. The tabs surrounding the top panel aperture can be of varying lengths. End panels are provided. The end panels are held substantially perpendicular to the top, bottom, and side panels by locking panels. The locking panels include apertures which are aligned with the bottom panel apertures and are sized to allow a bottle to pass therethrough, so that the bottle will hold the end panel in its position. The side panels can be of multiple plies.

39 Claims, 10 Drawing Sheets

BOTTLE CARRIER

CROSS-REFERENCE TO RELATED APPLICATIONS

Not Applicable

STATEMENT REGARDING FEDERALLY SPONSORED RESEARCH OR DEVELOPMENT

Not Applicable.

BACKGROUND OF THE INVENTION

This invention relates to paperboard bottle carriers, and in particular, to improvements in the carriers, to the carrier's tab configuration, and to the construction of the carrier to help prevent racking or shifting of the carrier in relation to the bottles held within the carrier.

Paperboard bottle carriers are well known, and many improvements to such bottle carriers have been made over the years. Currently, there are essentially two varieties of bottle carriers: the basket carrier, and the planar or box-top carrier. The basket carrier is in wide use, but suffers from being complex to fold and glue. The assembly of basket carriers thus requires special folding machinery, making such carriers expensive to produce. Planar, or box-top carriers, on the other hand, are formed from a generally rectangular blank. The box-top carrier blank has parallel fold lines to form the blank into an assembled carrier. Thus, complex machinery is not required to fold and assemble box-top carrier. Box top carriers have steadily been gaining acceptance in the market place.

The box top carrier relies on tabs to engage the bottle's cap or take-out bead to hold the bottles in the carriers. Many bottles transported in box-top carriers include tamper evidence seals, i.e., a plastic wrapping about the bottle cap. I have recently found that some tab constructions will break this seal. Obviously, this is an undesirable side effect. Further, some containers include foils or labels which cover the take-out bead. These foils or labels may also be broken by the tabs when the carrier is applied to the container. What is needed is a tab construction which is sufficiently strong to hold a desired size bottle in a carrier, yet is not so strong or rigid that it will break the seal, foil, or label during application of the carrier to bottles.

Additionally, because the box-top carrier basically sits on the top of the bottles, the carrier is essentially sitting on a fulcrum. The carrier can thus rack or pivot about the necks of the bottles. This is especially true in a typical 3-pack carrier, which carries three bottles all contained in a single line.

Other improvements can be made to the carrier to improve the overall quality of box-top carriers to make them stronger and easier for customers to lift.

BRIEF SUMMARY OF THE INVENTION

Briefly stated, a new and improved bottle carrier is provided. The carrier includes a top panel, side panels, and a bottom panel extending between the side panels to form a generally rectangular sleeve. The top and bottom panel both include a plurality of apertures, the apertures of the top and bottom panel are generally aligned, so that a bottle which is passed through the bottom panel aperture will pass through the related top panel aperture.

The top panel is made from two plies which overlie each other. The top panel apertures are formed in the two plies.

The top ply includes a plurality of slits radiating from each aperture edge to define a plurality of tabs. Each tab has a base, and the bases of the tabs, in turn, define a circle concentric about the top panel aperture. The circle defined by the tab bases has a different diameter than the second ply apertures, such that the tab bases are radially offset from the edge of the second ply apertures. In one instance, the circle defined by the top ply tabs is larger in diameter than the second ply apertures. In this instance, the tab bases are supported by the second panel. Preferably, in operation, the tabs engage the bottle chime at an angle of less than 45°. In another instance, the circle defined by the top ply tabs is smaller in diameter than the second ply apertures. In this case, the tab bases are unsupported by the second or bottom ply, and the bottles are more easily removed from the carrier.

The carrier can also include a tongue extending from the edges of the bottom ply apertures. The tongue extends from the bottom panel to the top panel to help hold the two panels apart. This will help reduce arching of the top panel. The tongue can also engage the bottles to help maintain the bottles generally centered relative to the carrier apertures. This contact of the tongue with the bottle helps reduce racking of the carrier about the bottles. When the carrier is applied to a set of bottles, and the tongue is elevated, the tongue takes on a curvature. This curvature makes the tongue stiffer. The tongue has a maximum length equal to the diameter of the bottom panel aperture so that the tongue, will, at a maximum, extend to the bottom of the top panel.

The bottom panel apertures can be elliptical or offset from the top panel apertures. This produces a sideways thrust which can tilt the bottle in the carrier. The tongues, depending on their length, can counter-act this force, and can be used to urge the bottle in a desired direction.

The carrier side walls can be two-ply side walls. To produce a carrier with two-ply side walls, a blank is provided with two extra sections which form the extra plies of the side walls. Preferably, the extra panel sections are formed on either side of the top panel bottom ply. To be able to form the carrier with the second plies for the side walls, the hinge of fold line between on one side of the bottom ply must at least be slitted to allow for compression of the blank material along the fold line. On the other side, the hinge or fold line should be perforated, so that, upon folding, the side wall ply will separate from the bottom ply.

The carrier can be provided with three elongate finger holes in the top panel to enable a customer to hold the carrier in any one of a number of six possible positions. The finger holes are elongate and define a center finger hole and outer finger holes. The outer finger holes are generally perpendicular to the side edge of the carrier; and the center finger hole is generally perpendicular to the end edges of the carrier. The finger holes are closed by flaps. The outer finger holes are each closed by two flaps which are separated by a line of weakness extending generally perpendicularly to the side edges of the carrier. The center finger hole may be closed by four flaps separated from each other by lines of weakness. The four flaps comprise a pair of outer flaps and a pair of inner flaps. The outer flaps are generally trapezoidal in shape and have inner edges that run generally perpendicular to the side edges of the carrier. The inner flaps are separated by a line of weakness extending between the inner edges of the outer flaps. The lines of weakness preferably are score lines, but could also be perforations.

The carrier can be provided with one or more concentric (or nearly concentric) rings around the bottom panel apertures to enable the carrier to accommodate bottles of differing sizes. The rings are defined by lines of weakness. When the carrier is applied to a set of bottles, the near-concentric rings can form a truncated cone around the bottle, with an inner edge of the cone in contact with the bottle. If the bottle wall is shallow enough, the individual rings can separate, and the carrier can form separate rings about the bottle.

The carrier can also be provided with one or two end panels which close the ends of the carrier. The end panels extend the height and width of the carrier ends. A locking panel is provided for each end panel to hold the end panel substantially perpendicular to the side panels, the top panel, and the bottom panel without the use of glue. The locking panel is positioned adjacent the bottom panel and includes apertures which are generally aligned with the bottom panel apertures when adjacent the bottom panel. When the carrier is applied to a set of bottles, the bottles will extend through the locking panel apertures and the bottom panel apertures.

BRIEF DESCRIPTION OF THE SEVERAL VIEWS OF THE DRAWINGS

Corresponding reference numerals will be used throughout the several figures of the drawings.

DETAILED DESCRIPTION OF THE INVENTION

Figure 1:
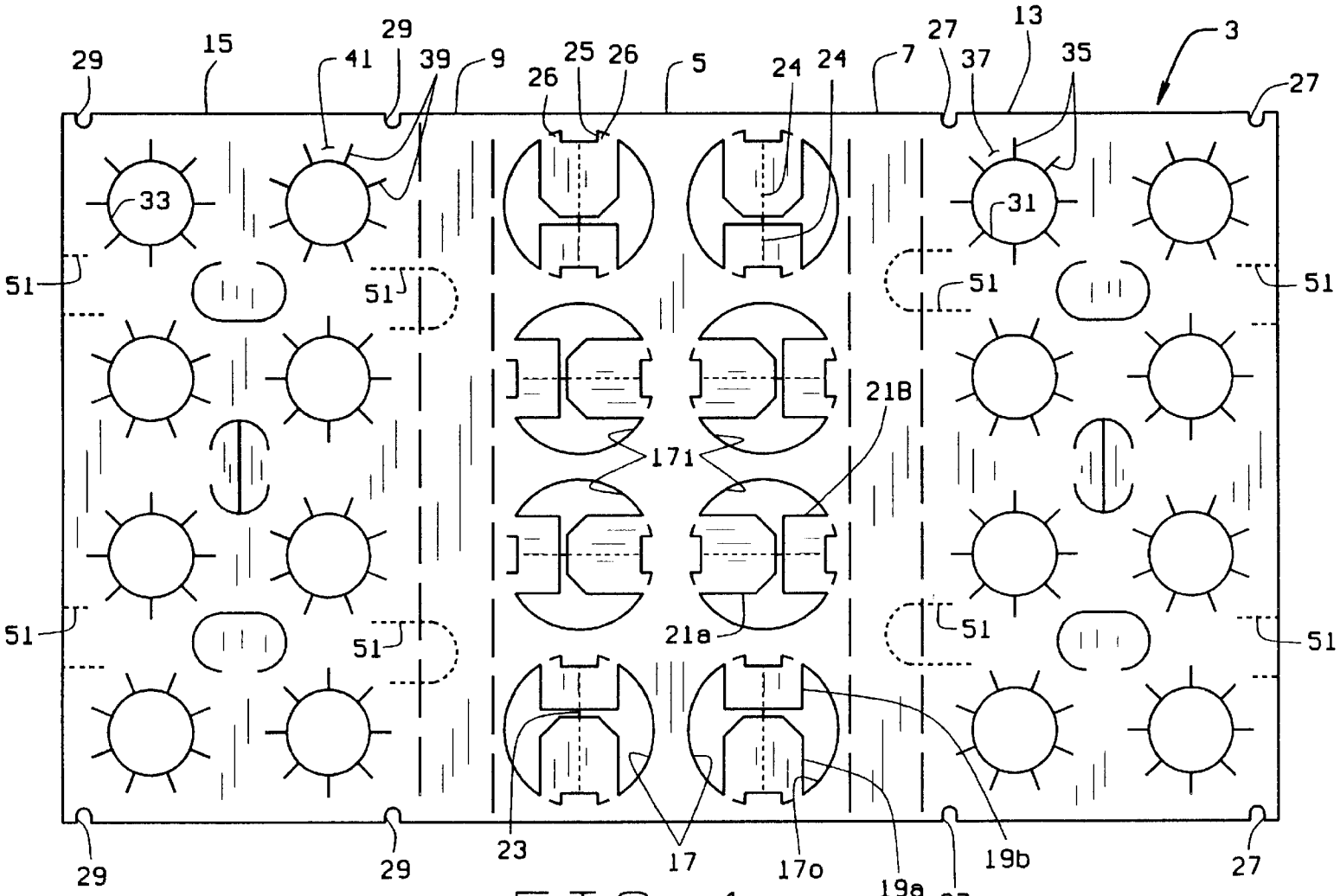
FIG. 1 is a plan view of a blank used to form one illustrative carrier of the present invention.

The following detailed description illustrates the invention by way of example and not by way of limitation. This description will clearly enable one skilled in the art to make and use the invention, and describes several embodiments, adaptations, variations, alternatives and uses of the invention, including what I presently believe is the best mode of carrying out the invention.

A bottle carrier 1 is made from a blank 3. As noted in my previous patent, U.S. Pat. No. 5,590,776, which is incorporated herein by reference, the carrier is preferably made of paperboard, but can be made of any suitable material which can be easily folded and assembled to form the carrier from the blank.

The carrier 1 includes a bottom panel 5, side panels 7 and 9 which extend up from the bottom panel, and a top panel 11 which extends between the side panels. The bottom panel 5 has continuous, uninterrupted edges extending between the side panels 7 and 9. The top panel is a two ply top panel, and includes a top ply 13 and a bottom ply 15.

Figure 2:
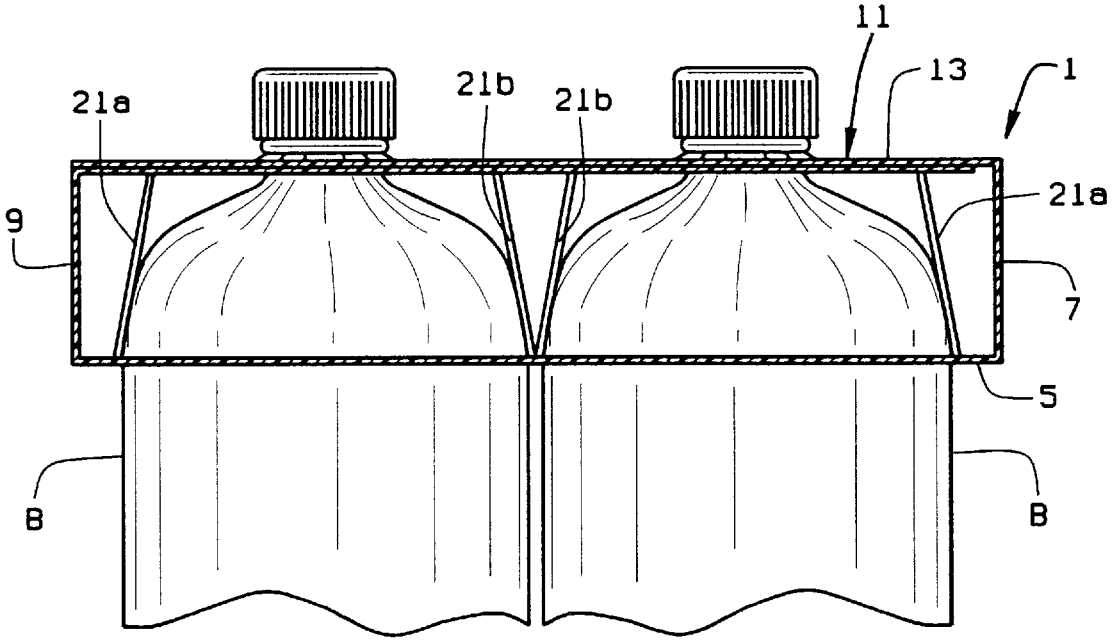
FIG. 2 is a cross-sectional view of a carrier formed from the blank, with bottles therein, showing how tongues in the lower panel extend along the side of inner bottles.
Figure 3:
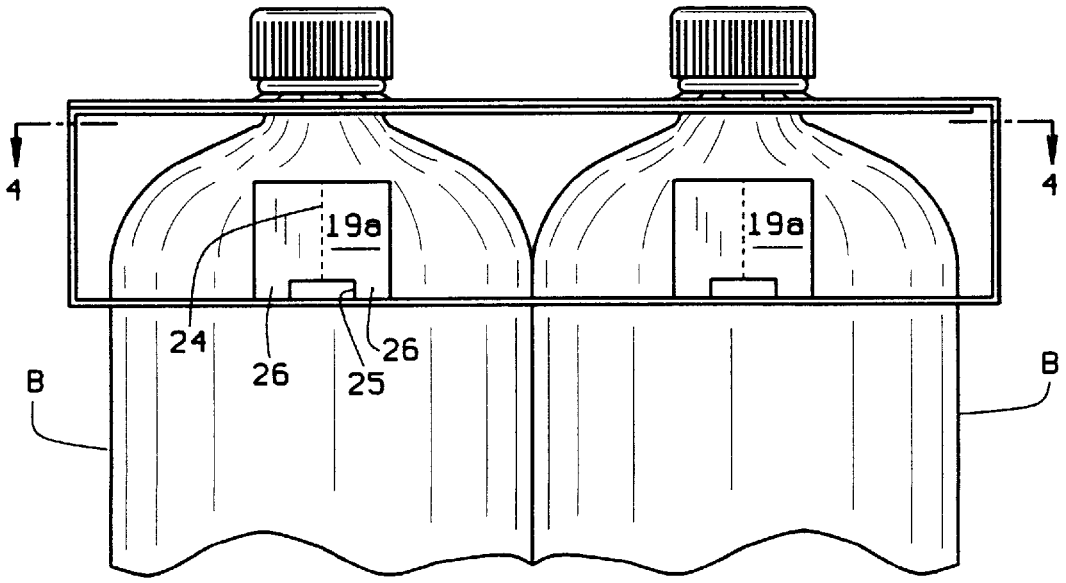
FIG. 3 is an end elevational view of the carrier showing tongues extending along the sides of outer bottles.
Figure 4:
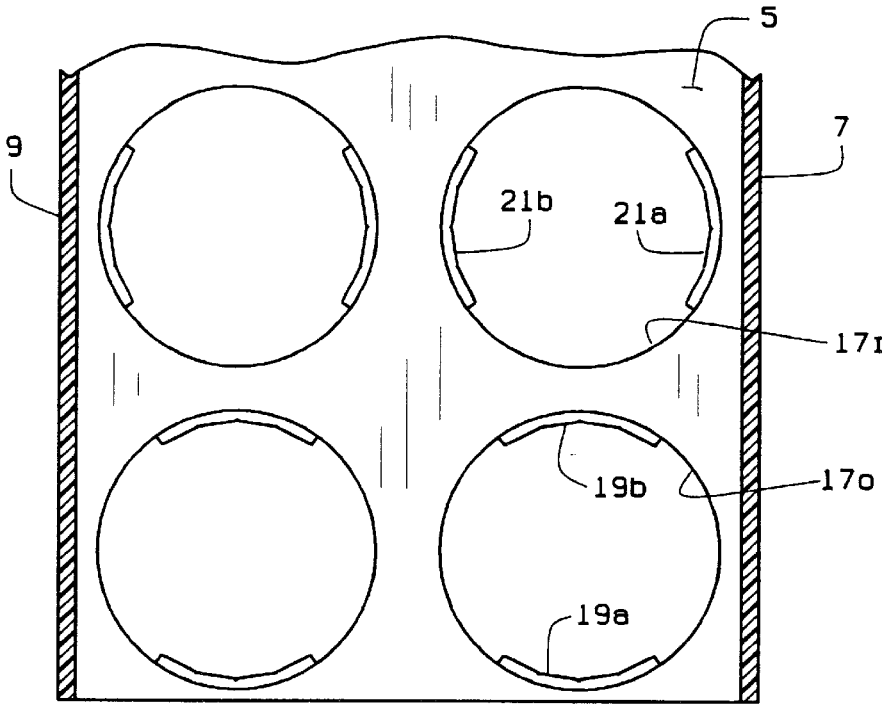
FIG. 4 is a cross-sectional view of the carrier, taken along line 4—4 of FIG. 3 (but without the bottles), showing top plan views of the tongues when bottles are received in the carrier.

The bottom panel 5 includes a plurality of apertures 17, one aperture 17 for each bottle to be held by the carrier. The are eight apertures 17 shown in FIG. 1 arranged in a 2×4 array to define two pair of outer apertures 17O and two pair of inner apertures 17I. However, there could be more or fewer apertures, arranged in a 1×n, 2×n, 3×n, etc. array. As seen in FIGS. 1–3, the carrier includes tongues 19*a,b* and 21*a,b* which extend across the apertures 17O and 17I, respectively. As seen, the tongues 19*a,b* run parallel to the side walls 5 and 9 and the tongues 21*a,b* run perpendicular to the side walls 7 and 9. The tongues 19*a,b* and 21*a,b* are shown connected by a small strip 23 which is easily broken by a bottle cap when a bottle is urged through the apertures 17O,I. Thus, very little force is needed to break the strip 23, and the strips 23 will not impede the application of the carrier to a set of bottles. The strip 23 is formed by long cuts which substantially separate the distal ends of the tongues 19*a,b* and 21*a,b* from the edge of the apertures 17. The small strip 23 could be eliminated, so that the tongues 19*a,b* and 21*a,b* are not connected to the aperture edge at their distal ends. This would eliminate the need for extra force to break the small strip 23 as the carrier is applied to the bottles. As seen in FIG. 4, when the bottles are urged through the carrier bottom panel 5, the tongues take on a curvature corresponding generally to the curvature of the aperture.

The tongues can be provided with perforations 24 which extend along the tongues. Preferably the perforations are in the middle of the tongue. Additionally, the generally rectangular cutouts 25 can be formed at the base of the tongues, so that the tongues are effectively held to the bottom panel by legs 26. The cutout 25 can be replaced with a slit. This slit would have the same function as the cutout 25, and would not affect the function of the tongue. The use of the perforations 24 and the cutouts 25 or slits both help the tongue approximate the curvature of the aperture, as seen in FIG. 4. Here, curvature is used in the broad sense of the word. The curvature taken on by the tongue may be defined by segments of the tongue.

The tongues 19*a,b* and 21*a,b* do not directly support the bottles in the carrier. Rather, they engage or contact the under sides of the top panel to help stabilize the carrier relative to the bottles B in the carrier. Because the tongues do not support the weight of the bottles (the top panel tabs do this), the tongues, at a maximum, extend up to, and contact the bottom of, the top panel. When the tongues extend from the bottom panel to the top panel, as seen in FIG. 2, the tongues function to space the top and bottom panels apart. By maintaining a desired spacing between the top and bottom panels, the tongues can reduce the arching of the top and bottom panels. This counteracts, at least to some degree, the offsetting of the bottom panel apertures relative to the top panel apertures due to the arching of the panels. Further, it will alleviate or counteract lateral forces exerted on the bottle by the side wall.

The tongues may also be shorter, as seen in FIG. 3, and extend only part way between the bottom and top panels. In this instance, the tongues exert a radial force on the bottle to help prevent racking or shifting of the carrier relative to the bottles. Depending on the slope of tongues, such as tongues 21*a,b* which extend to the top panel, the tongues can still exert some radial force on the bottles. The inner tongues 21*a* tend to urge the bottle outwardly, and the tongues 21*b* tend urge the bottle inwardly, relative to the apertures 17I. In concert, the tongues 21*a,b* tend to center the bottle in the aperture 17I. Similarly, the tongues 19*a,b* of the outer apertures 17O operate to center bottles in the apertures 17O. The tongues 19*a* tend to urge the outboard bottles toward the inboard bottles.

Although the carrier is shown with two tongues in each aperture, the carrier could include a single tongue in each aperture. A single tongue could extend across the fill width of the aperture or only across a part of the aperture. The free or distal end of the tongue can be connected to an edge of the aperture by the strip 23. By splitting the tongue in two, two narrower tongues could be provided. Alternatively, multiple tongues could be placed in each aperture. In this instance, the tongues would be equally spaced about the aperture, extending inwardly from the aperture edge.

The blank 3 can also be provided with notches 27 in the top panel top ply 13 and notches 29 in the top panel bottom ply 15. The notches 27 and 29 are positioned so that they will be in register with each other, to define notches through the top panel near each of the corners of the top panel. When the carriers 1 are initially formed, they are folded and glued. When so formed, the carrier is in a flattened state. This allows for many carriers to be placed in a single box for shipment. When the carriers are to be applied to sets of bottles, the carriers have to be expanded and squared. Generally, a plurality of carriers are held in a magazine of carriers. Individual carriers are removed from the magazine to be squared up and applied to sets of bottles. Sometimes, it can be problematic to separate the carrier bottom panel from the carrier top panel. They may be stuck together by a small amount of glue. Additionally, the memory of the material from which the blank is made may make it difficult to open or erect the carrier from its flattened state. The notches 27 and 29 in the plies of the top panel allow for fingers from the application machinery to extend through the carrier. These fingers can then be used to help separate the top and bottom panels. Either the fingers can be extended to push the bottom panel away from the top panel, or, the fingers can hold the bottom panel in place, and allow the machinery to pull the top panel away from the bottom panel. In either event, they facilitate that expansion and squaring of the carrier, so that the carrier can be applied to a set of bottles.

Figure 5A:
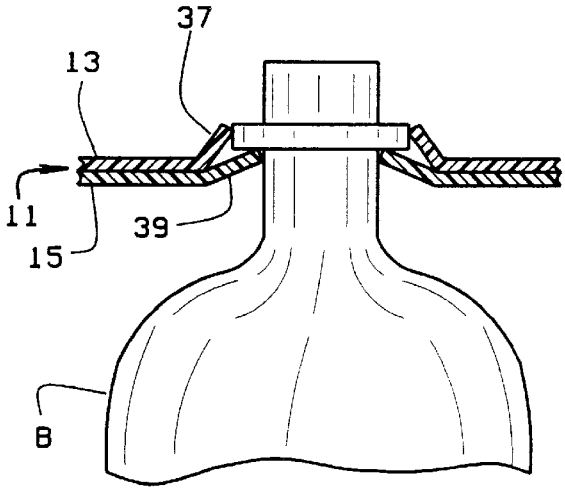
FIGS. 5A–C are fragmentary cross-sectional views of the carrier showing three different manners in which the tabs in the top and bottom plies of the top panel engage a bottle.

The top panel 11 includes a series of apertures which are generally aligned with the bottom panel apertures 17. The top panel apertures can, but need not, be concentric with the bottom panel apertures, as described in U.S. Pat. No. 5,878,876 which is incorporated herein by reference. The top panel apertures are defined by apertures 31 in the top ply and apertures 33 in the bottom ply. The top ply includes a plurality of slits 35 which radiate outwardly from the apertures 31 to form a plurality of tabs 37. Similarly, the bottom ply can include a plurality of slits 39 which radiate from the bottom ply apertures 33 to define bottom ply tabs 41. In U.S. Pat. No. 6,059,099, which is incorporated herein by reference, the base of the top ply tabs 37 is described to be offset from the base of the bottom ply tabs 39. However, as shown in FIG. 5A, the base of the top and bottom ply tabs can be aligned. That is, the base of the top ply tab can be directly above the base of the bottom ply tab. Thus, the circles defined by the top and bottom ply tabs would be of the same diameter, and would be concentric. Similarly, the top ply tabs and bottom ply tabs can be of the same length. Because the top and bottom ply tabs overlie each other, when the carrier is applied to the bottle, and the bottle pushes the tabs out of the plane of the carrier top panel, the top ply tabs will extend further than the bottom ply tabs. Thus, the top and bottom ply tabs will engage the bottle at two different planes on the bottle, as described in the just-noted patent application.

The tabs 37 and 41 are formed to prevent, as much as possible, the tab base lines from being perpendicular to the grain or machine direction of the paperboard. When the base line is perpendicular to the machine direction, the tab is parallel to the machine direction. When a tab is parallel, or runs with, the machine direction, the tab will have little to no "memory." Thus, when the carrier is applied to the bottles, the tab may not snap back under the chime or other engagement point on the bottle. This can result in an unequal loading of the tabs.

In FIG. 5A, the bottom ply tabs 39 are shown to engage the bottle B, and support the bottle in the carrier. The top ply tabs 37 extend up and are in an angular, but non-load bearing, contact with the bottle. In this construction, the top ply tabs 37 push against the bottle and urge the bottle radially inwardly to help maintain the bottle B generally in the center of the top panel aperture.

Figure 5B:
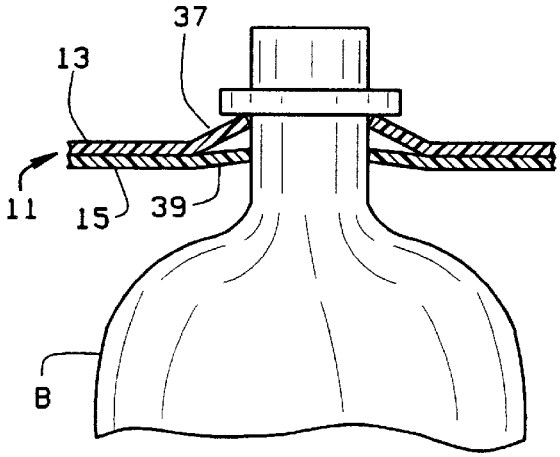

In FIG. 5B, the top ply tabs are the load or weight bearing tabs. The bottom ply tabs may or may not engage the bottle. In this instance, when the bottom ply tabs engage the bottle, they exert a radial force on the bottle, and urge the bottle radially inwardly. Thus, the bottom ply tabs will help provide a centering force to help center the bottle B relative to the top panel apertures.

Figure 5C:
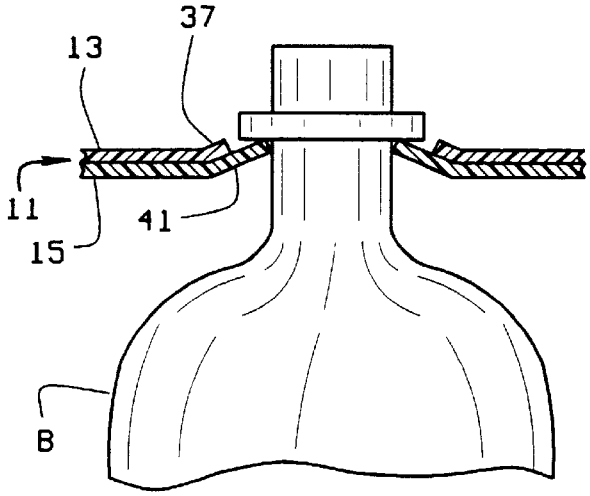

In FIGS. 5A and 5B, the top and bottom ply tabs are substantially of the same length. In FIG. 5C, the top ply tabs 37 are shorter than the bottom ply tabs 41. The bottom ply tabs engage the bottle, and are the load bearing tabs. The top ply tabs do not engage the bottle. Rather, they bear against the bottom ply tabs, to urge the bottom ply tabs radially inwardly. Thus, the top ply tabs act as reinforcements for the bottom ply tabs, to help the bottom ply tabs engage the bottle chime. This is especially advantageous when the bottle has a very small lip for the tabs to engage.

Figure 6A:
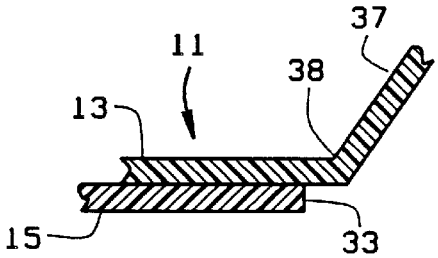
FIGS. 6A–C are enlarged fragmentary cross-sectional views of the top panel, showing the base of the tab in different positions relative to the edge of the second ply aperture.
Figure 6B:
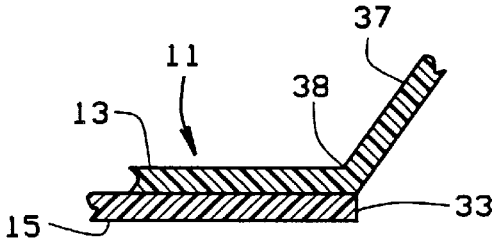
Figure 6C:
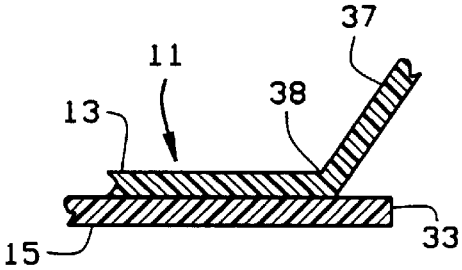

In FIGS. 6A–C, the carrier is shown with tabs 37 in the top panel top ply 13, but with no tabs in the top panel bottom ply 15. In FIG. 6A, the base of the top ply tabs 37 is set in radially from the edge of the bottom ply aperture 33. Thus, the circle defined by the top ply tab bases is smaller in diameter than the bottom ply aperture 33. In FIG. 6B, the circle defined by the bases of the top ply tabs 37 is substantially equal in diameter to the bottom ply aperture 33. Thus, the base of the tabs 37 is positioned generally at the edge of the aperture 33. In FIG. 6C, the top ply tabs 37 define a circle larger than the bottom ply aperture 33, and the bases of the tabs 37 are supported by the bottom ply 15. The amount of radial offset of the top ply tabs relative to the bottom ply apertures affects the holding power of the carrier.

When the base of the top ply tabs is offset radially inwardly from the edge of the bottom ply apertures (as in FIG. 6A), the bases of the tabs 37 are not supported. This allows for easier removal of the bottle from the carrier. When the base of the tabs are unsupported, as shown in FIG. 6A, when a downward force is applied to the bottle (i.e., the bottle is pulled downwardly through the carrier) the tab will simply collapse. The greater the difference in size between the bottom ply aperture and the circle defined by the tab bases, the easier it will be to remove the bottle from the carrier simply by pulling the bottle through the carrier. As the tabs 37 collapse, they will crunch up and fill in the area between the bottle and the edge of the bottom ply aperture. As the area between the edge of the bottom ply aperture and the bottle increases, a crumpled tab will be unable to fill in the area, and the bottle will simply slide through the apertures when pulled.

When the bottom ply apertures 33 and the bases of the top ply tabs 37 define circles of the same size (FIG. 6B), the base of the tab will be supported by the bottom ply 15. In this instance, more force is required to pull the bottle through the carrier than is needed for the tab configuration of FIG. 6A. When the circle defined by the tab base and the bottom ply aperture are of substantially the same size, the tabs work best when they engage the bottle at an angle of greater than about 45°, as set forth in the above mentioned patents. While this angle provides good support for the bottles, the tab can break tamper evidence seals when the carrier is applied to bottles.

When the diameter of the circle defined by the tabs is greater than the diameter of the bottom ply aperture (FIG. 6C) the holding power of the carrier is the greatest. In this configuration, the tab bases 38 are supported by the bottom ply and are spaced radially outwardly of the bottom ply aperture 33. Because the tabs are supported, the tabs are given some support, and the bottle is harder to remove. Further, because the tabs are longer, and engage the bottle a much lower angle, preferably less than 45°, and preferably, less than 35°. When the bottle is received in the carrier, the downward forces of the bottle will be transferred laterally from the tabs to the top panel. Thus, less of the downward force of the bottles on the tabs will be focused at the base of the tabs. When the tabs close up (i.e., engage the bottle), this lateral shifting of the downward forces creates an even stronger binding effect of the carrier on the bottle. However, when the carrier is applied to the bottle, the tab gives a more gentle wiping action over the bottle seals, and is less likely to break the seals that are often applied to bottles. Further, when a bottle is pulled downwardly, the tab will simply be pulled through the top panel aperture. The tabs of FIG. 6C are thus not compromised when a bottle is pulled from the carrier. Whereas the tabs of FIGS. 6A or B can only withstand one or two reinsertions, the tabs of FIG. 6C can withstand multiple reinsertions (i.e., the bottle can be removed and reinserted several times) and the carrier will still hold the bottle.

Figure 7:
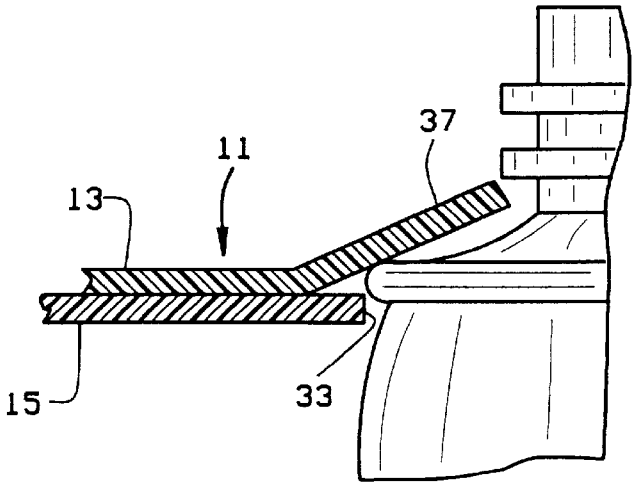
FIG. 7 is an enlarged fragmentary cross-sectional view showing an offset tab engaging a bottle held in the carrier.

As can be seen, in FIG. 7, the tab 37 engages the bottle at an angle of less than about 45°. Depending on the application, the tab angle could be about 35°, 25°, or even lower. If such a tab angle were used with the aperture orientation of FIGS. 6A or 6B, the tab would likely fail. However, in the aperture orientation of FIG. 6C, the tab base is supported by the bottom ply outwardly of the edge of the bottom ply aperture. Further, because of the low angle of the tab, as shown in FIG. 7, the downward forces applied to the tab by the bottle (either when the carrier is being carried, or when the bottle is being pulled through the carrier) are directed laterally from the tabs to the top panel, to be carried in part by the top panel. Thus, the tabs 37 and bottom ply 15 act together to support a bottle in the carrier, even when the tab angle is a very low angle (i.e. less than about 35°). This low angle is advantageous when working with bottles having a tamper seal. Whereas prior tabs may break the tamper seal when the carrier is applied to the bottle, the tabs 35 of FIG. 6C and 7 glide over the tamper seal (which is above the take out-bead) without damaging the bottle's tamper seal.

Returning to FIG. 1, the carrier is provided with pull tabs 51. The pull tabs 51 extend from the side walls 7 and 9 toward the apertures. They are shown positioned between rows of apertures in the top panel, and have a width approximately equal to the width between the rows of apertures. The pull tabs can also be positioned to be approximately on center with the rows of apertures. In this case, the tabs would have a width approximately equal to the neck of the bottle held by the carrier. Thus, when a pull tab 51 is pulled, it will open the top panel aperture, allowing the bottle to easily be pulled through the top panel and hence, to be easily removed from the carrier. As can be seen, the pull tabs 51 comprise a top ply segment and a bottom ply segment which are positioned to be in registry with each other. Thus, when the pull tab is pulled, the apertures are opened through both plies of the top panel.

Figure 16:
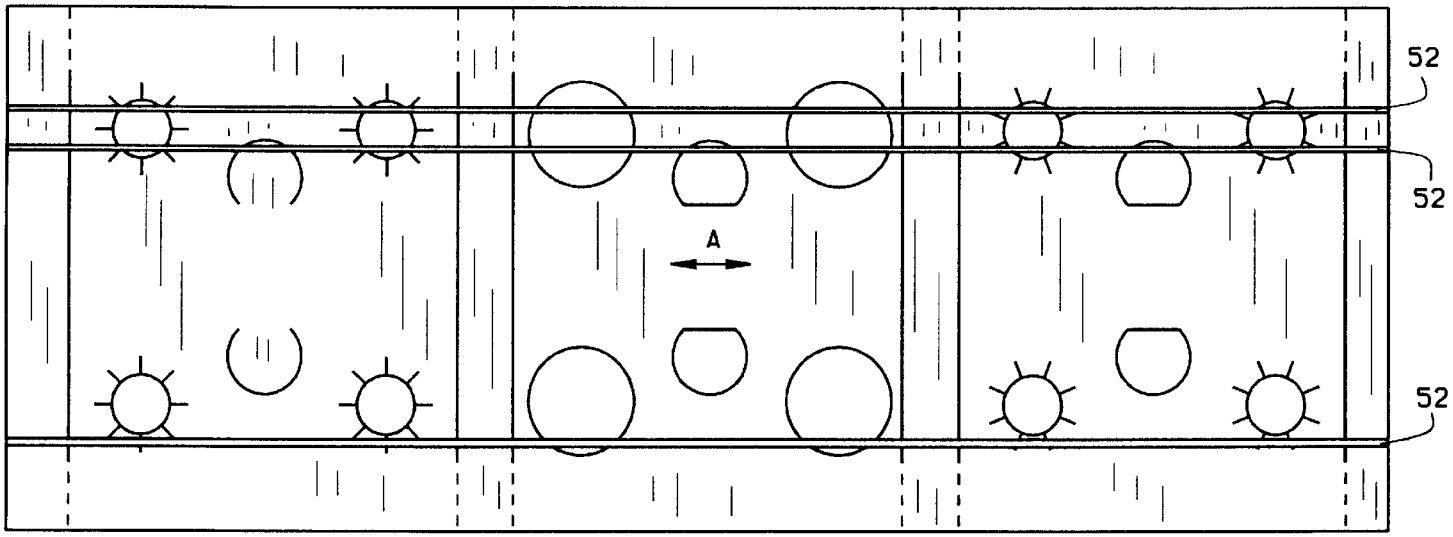
FIG. 16 is a plan view of a carrier blank provided with a rip cord to facilitate bottle removal from the carrier.

An addition to, or in lieu of, the pull tabs 51, the carrier can be provided with a rip cord or pull cord 52. (FIG. 16) A rip or pull cord 52 (such as is found in some paperboard boxes) can be applied to the carrier. The cord 52 is applied to the top or side panels, such that the cord 52 extends in the machine direction of the paperboard, as shown by the arrow A in FIG. 16. The carrier can have a single rip cord which extends the length of the carrier and which passes through at least one of the tab slits radiating from the top panel apertures. Alternately, the carrier can have a pair of rip cords, one on either side of the row of apertures. Each rip cord 52 would pass through at least one tab defining slit of each aperture. The rip cords can, alternatively, pass through the apertures them selves. The carrier can then be opened by pulling on the rip cord 52.

Figure 8:
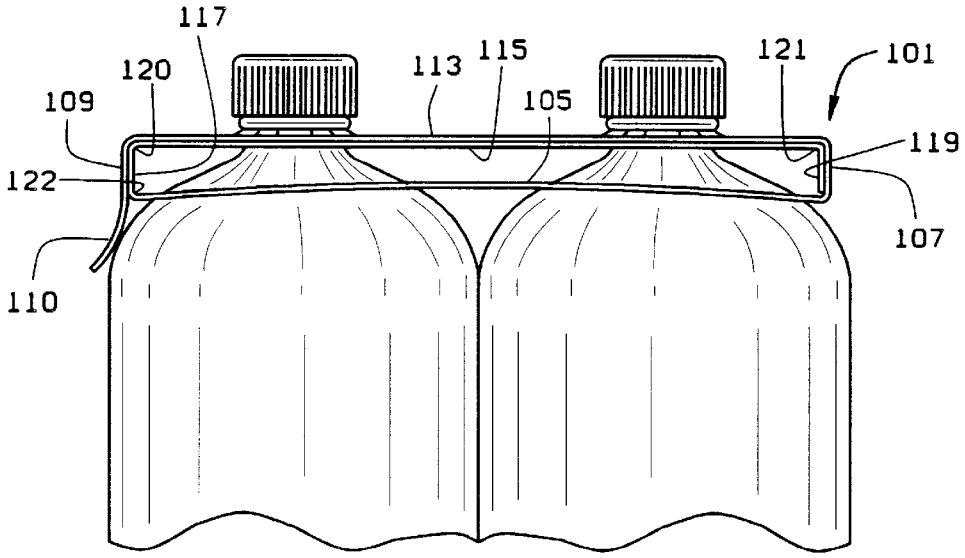
FIG. 8 shows a carrier with two-ply side panels, in addition to the two ply top panel.

An alternative carrier 101 is shown in FIG. 8. The carrier 101 includes two ply side walls, rather than the single ply side walls of the carrier 1 of FIG. 2. The carrier 101 also includes an advertising panel 110 which depends from the outer ply of one of the side walls. As can be seen, the carrier 101 is formed from a one-piece blank. The blank is similar to the blank 3 of FIG. 1. However, the blank for the carrier 101 includes extra panels for the extra plies of the side walls and a panel for the advertising panel 110. The use of double ply side walls increases the loading capabilities of the side walls. This will help maintain the top panel in a planar state (that is, it will help prevent the top panel from become arched when loaded), and hence, it will facilitate the carrier in transporting large bottles.

Figure 8B:
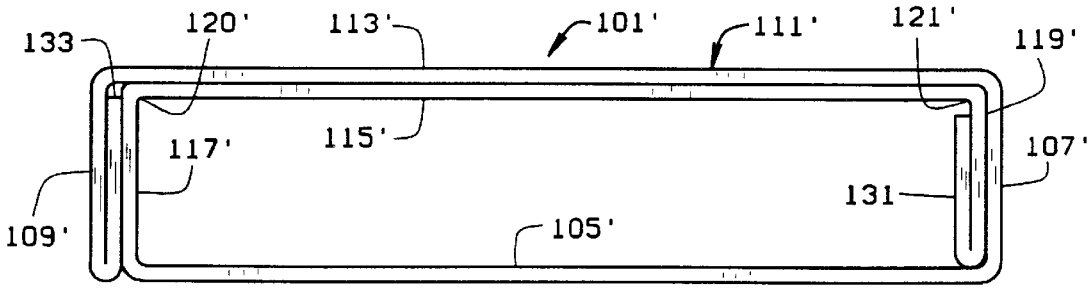
FIG. 8B is an end elevational view of a carrier having three-ply side panels.
Figure 8A:
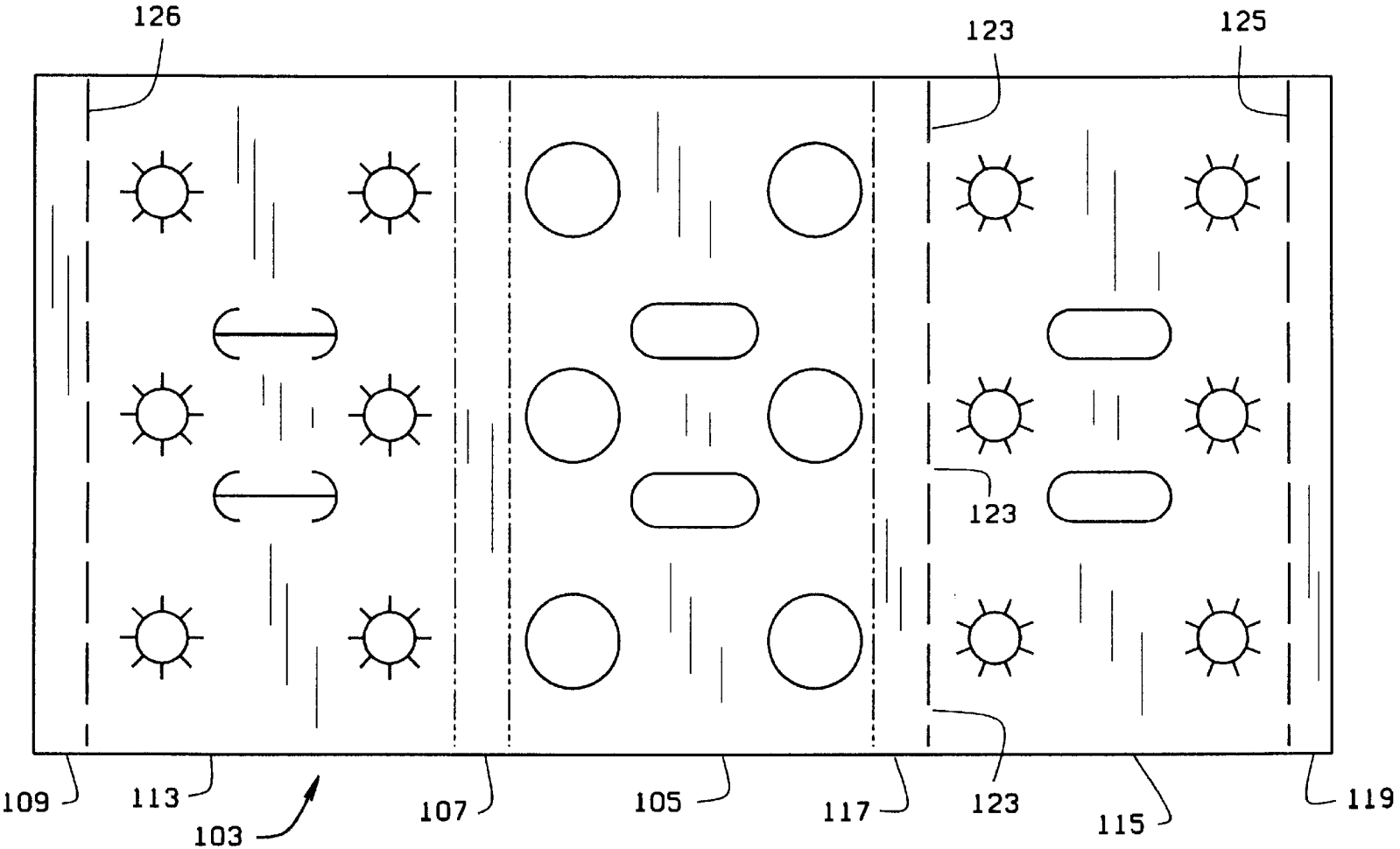
FIG. 8A is a plan view of a blank used to form the carrier of FIG. 8.

The blank 103 for the carrier 101 (less the advertising panel) is shown in FIG. 8A. The blank 103 includes (from left to right as seen in FIG. 8A) the outer side wall ply 109, the top panel top ply 113, the other outer side wall ply 107, the bottom panel 105, the first inner side wall ply 117, the top panel bottom ply 115, and the second inner side wall ply 119. When the blank 103 is folded into the carrier 101, the inner side wall ply 119 lies adjacent the inner surface of the side wall ply 107, and the inner side wall ply 117 lies adjacent the inner surface of the side wall ply 109. When the carrier is initially assembled and formed, it is in a flattened state. The carrier can be in a position in which it the material is folded 180° about the corners 121 and 122 which are cattycorner from each other. Before the carrier can be applied to a set of bottles, it must be erected, opened or squared. When the carrier is erected or squared from its flattened stated, the blank material in the corner 120 between blank sections 117 and 115 is placed in compression (which was flat prior to squaring), and the blank material in the corner 121 between the blank sections 115 and 119 (which was folded over upon itself prior to squaring) is placed in tension. The carrier can also be flattened in opposite direction. In this case, the carrier would be folded about its other two corners. Because of the compression and tension of the materials at the corners 120 and 121, if a simple fold line is used at these hinge points between the blank section 115 and the side wall inner ply sections 117 and 119 the inner plies would not lie adjacent the side wall outer plies 109 and 107.

To overcome the compression at the corner 120 and the tension at the corner 121, elongate slits 123 and 125 are provided at the fold lines between the top panel bottom ply 115 and the inner side panels 117 and 119, respectively. The slits 123 and 125 are preferably a series of long skip slits which slit about 90% to about 95% of the material along the respective fold line. When the carrier is squared, the slits 125 may break, causing the inner side panel 119 to physically separate from the top panel bottom ply 115. The slits 123 between the inner side panel 117 and the bottom ply 115 will not separate, and inner side panel 117 and the bottom ply 115 will remain physically connected. It may be necessary to add a third line of slits 126 at the fold line between the outer side panel 109 and the top panel top ply 113 to relieve tension at this fold line when the carrier is squared. When the carrier is squared, the slits 126 may separate, causing the outer side panel 109 to physically separate from the top ply 115. However, this can affect the graphics at this corner, a result which is obviously not desirable.

If the carrier were flattened in the opposite manner (i.e., folded about the corner 120 and the corner diagonally opposite corner 120, the slit 126 would be provided between the side wall outer ply 107 and the top ply 113. Instead of slit 125 breaking, slit 123 would break.

The second (inner) side wall plies could be provided as separate pieces which are glued to the outer side wall plies. However, this would require accurate placement of the second plies during gluing of the carrier. By making the blank a one-piece blank which includes both the inner and outer side wall plies, the gluing or construction of the carrier is made much easier. In gluing of the blank, glue is applied, for example, to panel sections 109, 113, and 107, and the blank is folded about its fold lines to bring the upper or outer surfaces of blank sections 117, 115, and 109 into contact with blank sections 109, 113, and 107, respectively. Thus, the problem of alignment of the inner side wall plies with the outer side wall plies during assembly of the blank is solved. When the carrier is squared, the inner side wall ply 121 separates, as noted above, to become independent. However, because it was previously glued to the outer side wall ply 119, it will stay adjacent the outer side wall ply 120.

Turning to FIG. 8B, a carrier 101' is shown having three-ply side panels. The carrier includes a top panel 111' having a top ply 113' and a bottom ply 115' and a bottom panel 105'. The right side wall includes an outer ply 107', a middle ply 119', and an inner ply 131. The other side wall includes an outer ply 109', a middle ply 133, and an inner ply 117'. As with the carrier 101, various hinge or fold lines will be placed in compression or tension, and will need to be relieved so that the carrier can be folded so that the three plies of the side walls will lie flat against each other. The material at the corner 120' at the fold line between the ply 117' and ply 115' will be placed in compression when the carrier is folded. Thus, the blank will need to be provided with slits equivalent to the slits 123 of blank 103. The material at the corner 121' at the fold line between the ply 119' and the ply 115' will be placed in tension. Thus, the blank will need to be provided with slits equivalent to the slits 125 of the blank 103. At the folds between plies 109' and 133, and between plies 119' and 131, the blank is folded 180°, rather than 90°. Thus, one surface of the blank at these fold lines is placed in tension, and the other is placed in compression. These fold lines can be defined either by simple embossments, or by slots, perforations, slits, or other lines of weakness which will allow the plies 133 and 131 to separate from the plies 109' and 119', respectively, as the carrier is folded and glued.

The side walls of bottle carriers are loaded when the carrier is applied to bottles. The loading of the side walls increases as the bottles are placed closer to the side walls. Thus, as the bottles are placed closer to the side walls, the arch which develops in the top and bottom panels when bottles are placed in the carrier, decreases. Therefore, by increasing the width or thickness of the side walls, or reinforcing the side walls by making the side walls two plies or three plies, the side walls' load carrying ability increases, and the carrier can be used to carry heavier bottles.

Figure 9:
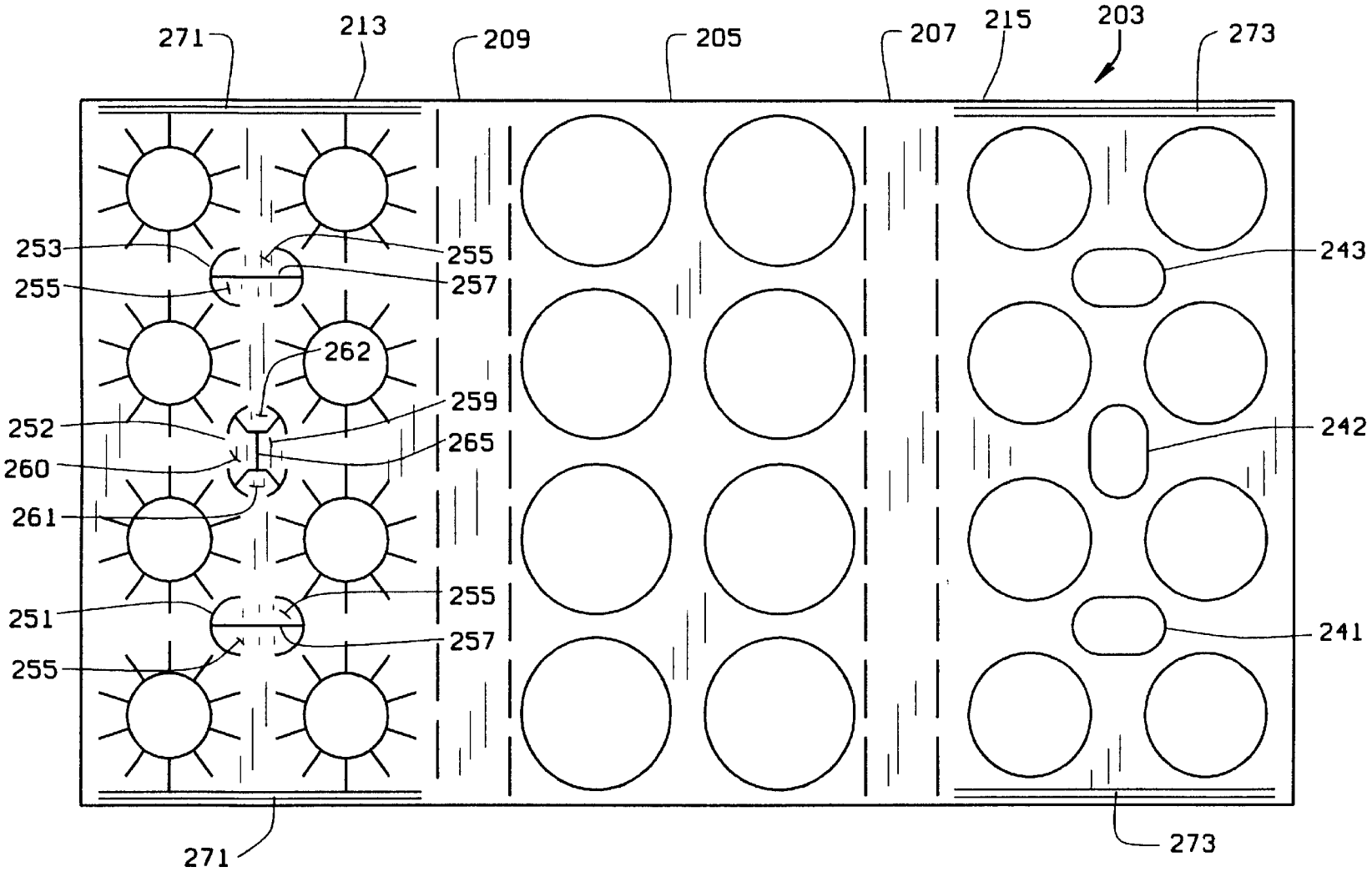
FIG. 9 is a plan view of a blank for forming a carrier having multiple finger holes, to enable a customer to carry the carrier in a desired fashion.

In FIG. 9, a carrier blank 203 is shown which has two-way and four-way finger holes. The carrier blank 203 includes a bottom panel 205, side wall panels 207 and 209, and a top ply panel 213 and a bottom ply panel 215 for the two plies of the carrier top panel. The two plies 213 and 215 of the top panel and the bottom panel 205 all include two rows of four apertures each, to form an eight pack carrier. The top panel bottom ply 215 has three finger holes 241, 242, and 243 between its two rows of apertures. The finger holes are elongate. The center finger hole 242 extends in a direction parallel to the two rows of apertures. The outer finger holes 241 and 243 extend perpendicularly to the center finger hole 242.

The top panel top ply 213 also has three finger holes 251, 252, and 253 which are positioned to be aligned with the bottom ply finger holes 241–243 when a carrier is formed from the blank. The top ply finger holes 251–253 are the same size and shape as the bottom ply finger holes 241–243. Unlike the bottom ply finger holes, the top ply finger holes 251–253 are not void. The outer finger holes 251 and 253 each have two flaps 255 separated by a score line 257. The flaps 255 are substantially equal in size. The center finger hole 252 has four flaps 259–262. The middle two flaps 259 and 260 are identical and the outer two flaps 261 and 262 are identical. The flaps 261 and 262 are outer or end flaps (they sandwich the flaps 259 and 260). The outer or end flaps 261 and 262 are generally trapezoidal in shape, with the base of the flap having a curvature equal to the curvature of the finger hole. The inner or center flaps 259 and 260 are separated from the end flaps 261 and 262 by score lines which define the edges of the end flaps, and are separated from each other by a score line 265.

The use of the three finger holes in the top panel gives a customer an option of how the carrier is to be handled. The customer can use only one of the outer finger holes 251 or 253 and grasp the carrier around the end of the carrier. Alternatively, the customer can carry the carrier using the center finger hole and one of the outer finger holes. If the customer has large hands, then the carrier can be carried using the two outer finger holes. Further, the customer can hold the carrier using the center finger hole and one of the sides of the carrier. Thus, there are many different positions in which the carrier can be held.

As can be seen, the center finger hole is a four-way finger hole, and the outer finger holes are two way finger holes. When the customer first places his/her fingers through the top ply finger holes, only the necessary flaps will be folded inwardly. The remaining flaps will not be moved. Thus, any graphics on the top panel will be left intact.

The blank 203 is also shown with embosses 271 and 273 in the top and bottom plies 213 and 215, respectively. The embossments 271 and 273 extend across the ends of the carrier generally parallel to the end edges of the carrier. They form a corrugation effect, and stiffen the top plies at their ends. This will add planar strength to the top panel at its ends to help maintain the top panel generally planar. The addition of end panels, as discussed below and shown in FIGS. 10 and 11, will also help maintain the to panel in a generally planar state.

Figure 10:
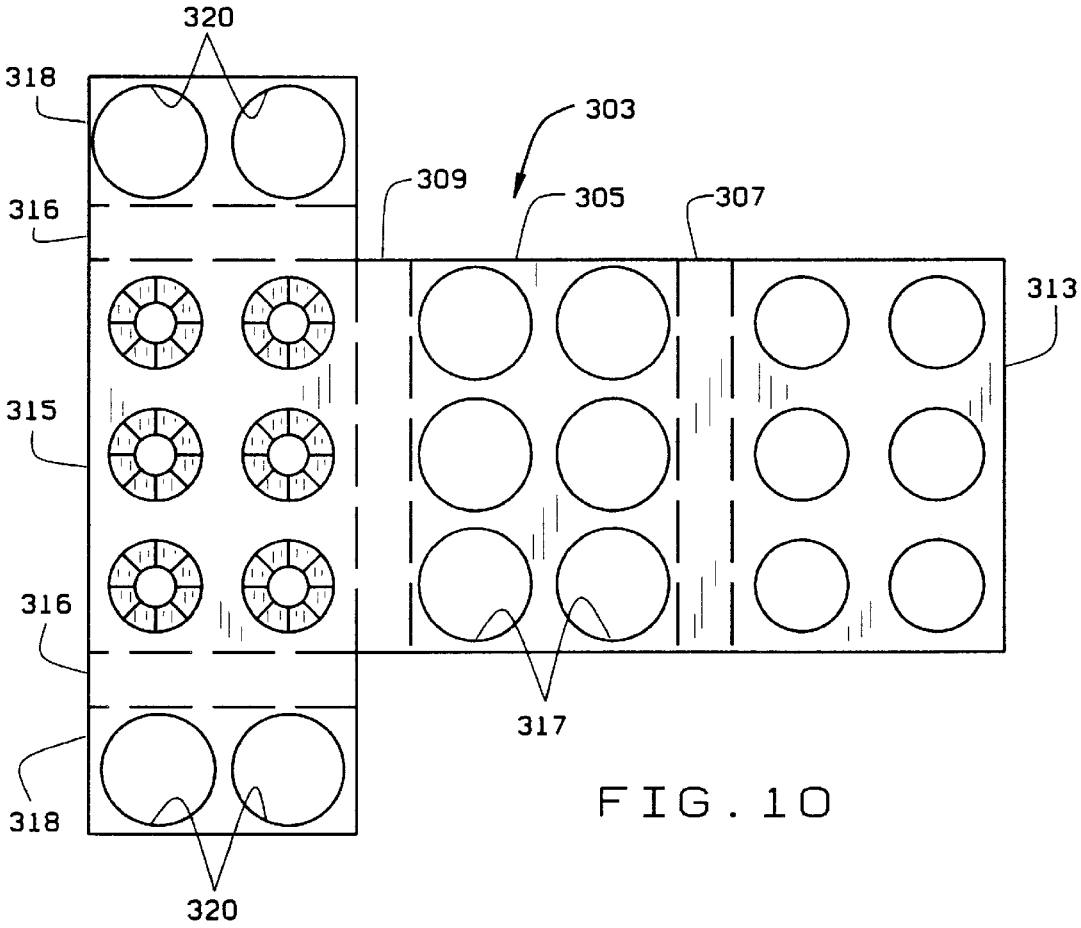
FIG. 10 is a plan view of a carrier blank which forms a carrier with end panels which are held in place.

A carrier blank 303 is shown in FIG. 10. The carrier 301 formed from the blank 303 is shown in cross-section in FIG. 11. The blank 303 includes a main or central section which has the bottom panel 305, the side panels 307 and 309, and the top and bottom plies 313 and 315 of the carrier top panel. End panels 316 are hingedly connected to the short edges of the top panel top bottom 315 by fold lines. The end panels could be connected to the top panel top ply 313, or even the bottom panel 305, instead. The end panels 316 can have a width approximately equal to the width of the top panel bottom ply 313. The height (or depth) of the end panels 316 may be equal to the height of the side walls 307 and 309. Alternatively, the height of the end panel can be adjusted or adapted to account for arching in the top and/or bottom panel. In this case, the end panels 316 would have a height that is less than the height of the side panels. However, in either event, when the carrier is folded, the end panels 316 will substantially close the ends of the carrier.

Figure 11:
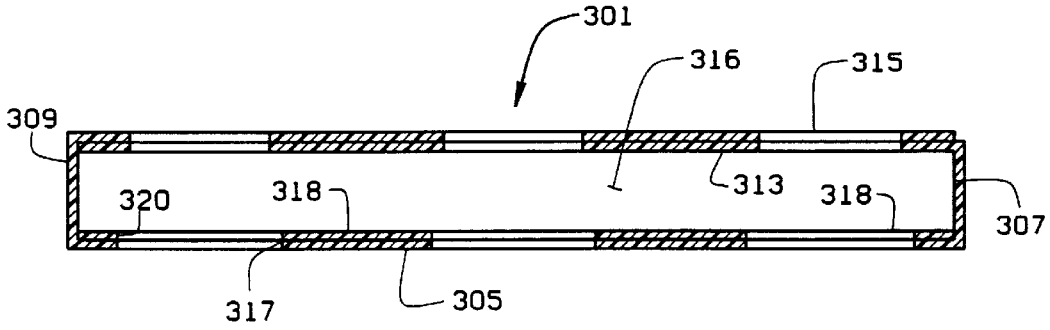
FIG. 11 is a cross-sectional view of a carrier formed from the blank of FIG. 10.

As is known, paperboard has a memory, and thus, unless the end panels 316 are fixed to the other panels of the carrier, they will not form a right angle with the edge of the carrier. To keep the end panels 316 at substantially a right angle to the top and bottom panels and to the side panels, the carrier includes panels 318 extending from the free ends of the panels 316. The panels 318 have apertures 320 which are equal in size to the bottom panel apertures 317. When the carrier is folded, the end panels 316 are folded to close the ends of the carrier, and the panels 318 are folded to lie either beneath or above the bottom panel 305. When the carrier is folded, the apertures 320 of panel 318 will be in register with the bottom panel apertures 317. In FIG. 11, the carrier 301 is shown with the panel 318 overlying the bottom panel 305. When the formed carrier is applied to a set of bottles, the bottles will extend through the bottom panel apertures 317, the apertures 320, and the top panel apertures. Thus, the bottles will effectively hold the end panels 316 in a generally vertical position. The panel 318 could also be glued to the bottom panel 305. As can be appreciated, the use of panel 318 also gives the bottom panel a partial second ply. This second ply, at the edges of the bottom panel, will help stiffen the bottom panel, and reduce the arch that is formed in the bottom panel when the carrier is applied to a group of bottles.

Figure 12A:
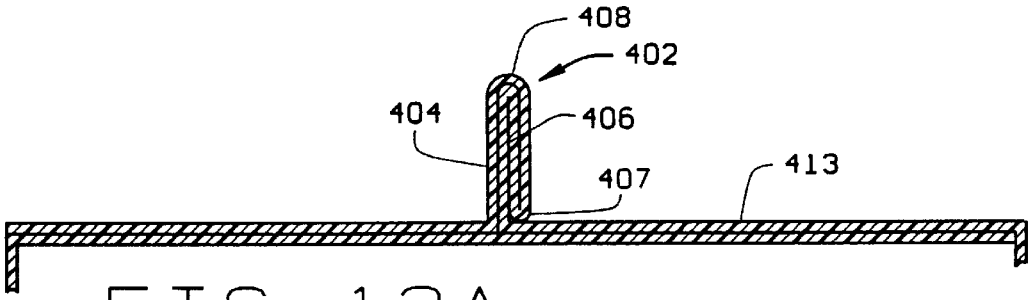
FIGS. 12A–C are fragmentary cross-sectional views of multi-ply handles for carriers.
Figure 12B:
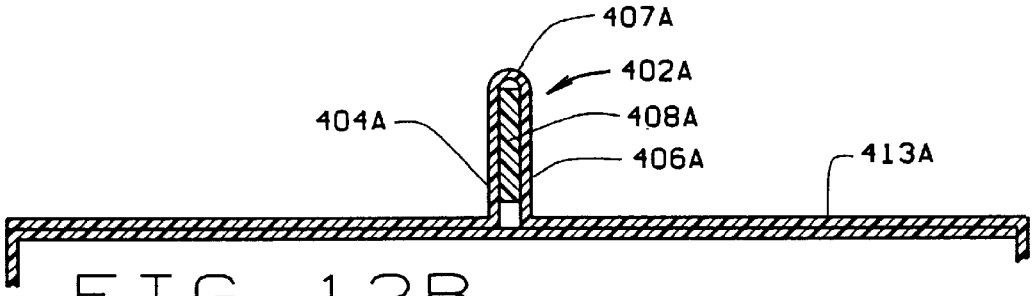
Figure 12C:
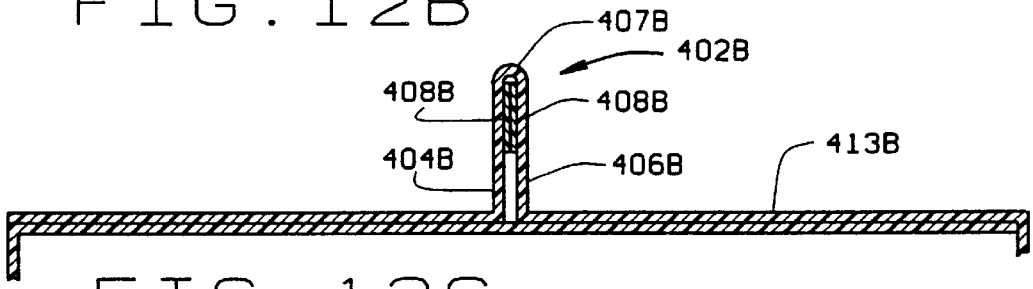

FIGS. 12A–C show three different handle configurations. In FIG. 12A, the carrier includes a handle 402 extending up from its top panel top ply 413, generally in the center of the top panel. The handle 402 is made up of two panel sections 404 and 406 of substantially the same length. The panel sections 404 and 406 are joined at a hinge point 407 to form a two ply handle. To make the two ply handle into a four ply handle, the panels 404 and 406 are folded over at a desired point, such as their mid-point, 408. Thus, panel 406 is folded over upon itself and panel 404 forms the outer surface of the handle.

A three-ply handle 402A is shown in FIG. 12B. The handle 402A, like the handle 402, extends up generally from the center top panel top ply 413A. The handle 402A is made up of two panel sections 404A and 406A of substantially the same length and which are joined at a hinge point 407A to form a two ply handle. A separate piece 408A is sandwiched between handle panels 404A and 406A to make the handle into a three-ply handle. The piece 408A, as indicated, is a separate piece, and is independent of the blank which forms the carrier. Thus, the inner piece 408A must be glued to the inner surface of one of the handle panels 404A and 406A prior to folding of the carrier, so that it will be properly aligned on the carrier handle.

A two-ply handle 402B is shown in FIG. 12C. The handle 402B, like the handle 402A, extends up generally from the center top panel top ply 413B. The handle 402B is made up of two panel sections 404B and 406B of substantially the same length and which are joined at a hinge point 407B to form a two ply handle. Fiber tape or cord 408B is sandwiched between handle panels 404A and 406A to reinforce the handles. Two strips of tape 408B are shown and are depicted to be generally in line with each other. More or fewer strips of tape could be used. Also, the multiple strips of tape need not be aligned with each other. The handle is in the machine direction. Thus, the handle will tear easily, especially when the carrier is loaded with heavy containers. The strips 408B of tape reinforce the handle to make it more difficult for the handle to be torn.

As can be appreciated, a multi-ply handle will be stronger than a single or a two-ply handle. The extra strength is beneficial, for example, when the carrier is a 12-pack of two-liter bottles.

Figure 13:
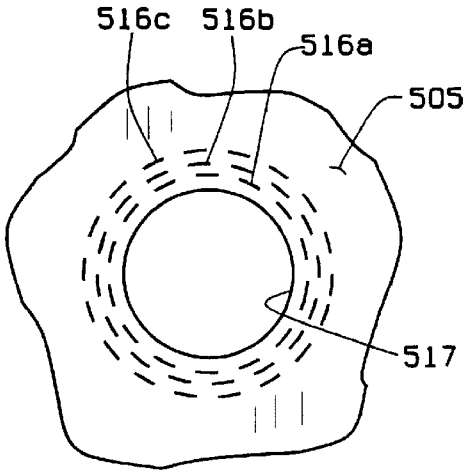
FIG. 13 is a fragmentary bottom plan view of the carrier bottom panel, showing an alternative bottom panel aperture construction.
Figure 14:
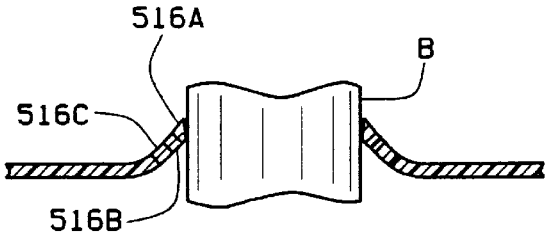
FIG. 14 is a fragmentary cross-sectional view of the bottom panel of FIG. 13 with a bottle extending through the bottom panel aperture.

FIG. 13 is a fragmentary sectional view of a carrier bottom panel 505 showing an alternative bottom panel aperture 517. The aperture 517 is surrounded by one, two, three or more concentric circles 516*a,b,c*. The circles 516*a–c* are defined by perforations, or other lines of weakness in the carrier bottom panel 505. The use of concentric rings allows for a single carrier to be used for bottles of varying sizes within a specified size range. A wider bottle will simply displace one or more of the rings defined by the circles 516*a–c* as the carrier is applied to the bottle. Depending on the diameter and taper of the bottle, the rings 516*a–c* may stay together, as shown in FIG. 14, or they may separate from each other. When the rings stay together, as shown in FIG. 14, the junction between the rings will stretch slightly, and the rings will define a truncated cone around the bottle B. The inner edge of the truncated cone, which is defined by the aperture 517, will be in contact with the bottle B, as seen in FIG. 14, and will bear against the bottle. This will help maintain the bottle generally centered with respect to the bottom panel aperture. For a bottle having a wider diameter, or a smaller slope, the rings 516*a–c* may separate from each other, as just noted. in this instance, the bottle body will be surrounding by one or more independent rings.

Figure 15A:
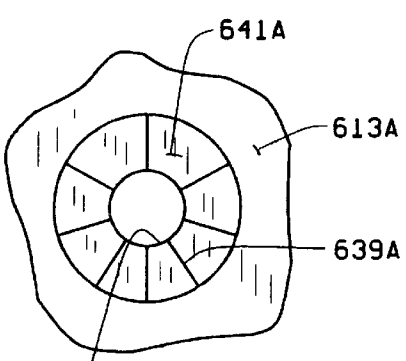
FIG. 15A is a fragmentary top plan view of the carrier top panel, and showing an alternative tab configuration, wherein the width of the tabs' bases vary.
Figure 15:
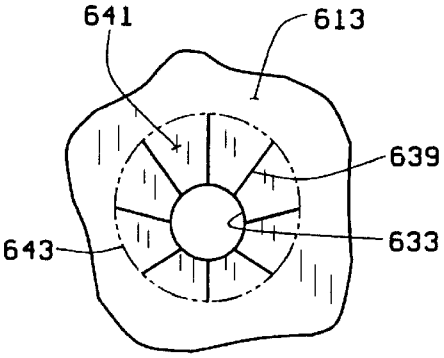
FIG. 15 is a fragmentary top plan view of the carrier top panel, showing an alternative tab configuration, wherein the top panel aperture is off center from the circle defined by the tab bases.

In FIG. 15, a fragmentary plan view of a carrier top panel top ply 613 is shown. The top ply 613 includes apertures 633 and a plurality of slits 639 extending from the edge of the aperture to define tabs 641. However, the tabs 641 are not of equal size, and the base line 643 of the tabs (shown in phantom in FIG. 15) defines a circle which is not concentric about the aperture 633. As discussed in U.S. Pat. No. 5,590,776, the carrier top panel arches when the carrier is applied to a set of bottles. As noted above, the amount of the arch is, in part, dependent on how far the bottles are from the side walls of the carrier. Because the carrier top panel may be arched, for a carrier having tabs of equal size, when the carrier is applied to a set of bottles, the top edges of tabs closer to the side wall will be higher than the top edges of the tabs closer to the center of the carrier. This will place a side load on the bottles which could urge the bottles outwardly. By providing tabs 641, which are of different length, the tabs can be designed to compensate for the arch, such that the top edges of the tab lie in a plane that is substantially horizontal (i.e., substantially parallel to the plane of the top panel and substantially perpendicular to the plane of the side walls). This will reduce the side thrust that is placed on the bottles which causes the bottles to separate.

In FIG. 15A, a fragmentary plan view of a carrier top panel top ply 613A is shown. The top ply 613A includes apertures 633A and a plurality of slits 639A extending from the edge of the aperture to define a plurality of tabs 641A, the base lines of which define a circle that is generally concentric about the aperture 633A. The bases of the tabs 641A are not of equal size. Rather, some are larger than others, so that some of the tabs are wider than others. As shown, one tab is widest, and the remaining tabs get progressively narrower in both directions, so that the tab opposite the widest tab will be the narrowest tab. By making one tab the widest, this tab can be made to bear more weight than the narrower tabs. For example, the outer most tab (or tab closest to the side panel) could be the widest tab, and the innermost tab could be the narrowest.

As various changes could be made in the above constructions without departing from the scope of the invention, it is intended that all matter contained in the above description or shown in the accompanying drawings shall be interpreted as illustrative and not in a limiting sense. For example, the end panels could include a tab, rather than locking panel described above. The tab would be folded to lie adjacent the bottom panel, and could be glued to the bottom panel, or could simply lie adjacent the bottom panel. In the latter instance, the end panel may not be substantially perpendicular to the top, bottom, and side walls of the carrier. The tabs could be provided with embossments at their bases. The tab bases could either be straight or curved. These examples are merely illustrative.

What is claimed is:

1. A bottle carrier for transporting a plurality of bottles, the carrier including:

a top panel comprising a first ply and a second ply, the first and second plies each having a plurality of generally aligned apertures, the top ply apertures and bottom ply apertures each having an edge; the top ply including a plurality of slits radiating from each aperture edge to define a plurality of tabs; each said tab having a base; the tab bases defining a circle about the top panel apertures; the circles defined by the tab bases having a different diameter than the second ply apertures, such that the tab bases are radially offset from the edge of the second ply apertures;

a pair of side panels depending from opposing sides of the top panel; and a bottom panel having a plurality of apertures therein, the bottom panel apertures being defined by edges.

2. The carrier of claim 1 wherein the circle defined by the top ply tab bases is larger in diameter than the second ply apertures; the tab bases overlying the bottom ply of the top panel.

3. The carrier of claim 2 wherein the tabs engage the bottle at an angle of less than 45°.

4. The carrier of claim 1 wherein the circle defined by the top ply tab bases is smaller in diameter than the second ply apertures; the tab bases being unsupported by the top panel bottom ply when the carrier is loaded.

5. The carrier of claim 1 including at least one tongue extending from the edge of the bottom ply apertures.

6. The carrier of claim 5 wherein the tongue takes on a curvature which approximates the curvature of the bottom panel aperture when the carrier is applied to bottles.

7. The carrier of claim 6 wherein the tongue has a line of weakness extending at least partially along the tongue.

8. The carrier of claim 6 wherein the tongue includes a fixed end about which the tongue bends, at least a portion of the tongue base being separated from the edge of the bottom panel aperture.

9. The carrier of claim 8 wherein the tongue includes a notch at its base thereof to separate the at least a portion of the tongue from the aperture edge, the notch defining a pair of legs which hold the tongue to the carrier bottom panel.

10. The carrier of claim 5 wherein the tongue engages a bottom surface of the top panel.

11. The carrier of claim 5 wherein the tongue lies in the plane of the bottom panel prior to the carrier being applied to bottles; the tongue, being held in place by a strip which extends from a free end of the tongue to an edge of the aperture or the edge of another tongue.

12. The carrier of claim 1 wherein the side panels are two-ply side panels, the side panels each having an outer ply and an inner ply adjacent an inner surface of the outer ply.

13. The carrier of claim 12 wherein the carrier is formed from a blank, the side panel inner plies being hingedly connected to a top panel ply; the carrier including a lines of weakness extending substantially the full length of the hinges between the side panel inner plies and the top panel ply to which the side panel inner plies are connected.

14. The carrier of claim 13 wherein the line of weakness covers at least 90% of the hinge line between the side panel inner ply and the top panel.

15. The carrier of claim 14 wherein the line of weakness is formed such that when the carrier is formed from the blank, one of the side panel inner plies will separate from the top panel ply to which it is connected.

16. The carrier of claim 1 including three elongate finger holes in the top panel; said finger holes being elongate and defining a center finger hole and outer finger holes; the outer finger holes being generally perpendicular to the side edge of the carrier; the center finger hole being generally perpendicular to end edges of the carrier; the finger holes all being closed by flaps;

the outer finger holes each being closed by two flaps, the two flaps being separated by a line of weakness;

the center finger hole being closed by four flaps separated from each other by lines of weakness; the four flaps comprising a pair of end flaps and a pair of central flaps.

17. The carrier of claim 16 wherein the end flaps are generally trapezoidal in shape and have inner edges that run generally perpendicular to the side edges of the carrier; the central flaps being separated by a line of weakness extending between the inner edges of the outer flaps.

18. The carrier of claim 16 wherein the lines of weakness comprise score lines.

19. The carrier of claim 1 wherein the carrier bottom panel includes one or more concentric rings around the bottom panel apertures to enable the carrier to accommodate bottles of differing sizes; said rings being defined by lines of weakness.

20. The carrier of claim 1 wherein the carrier includes end panels which close the ends of the carrier; the end panels extending the width of the carrier; the end panels having a height sufficient to substantially close the ends of the carrier when the carries is applied to a group of bottles; the carrier further including a locking panel for each end panel to hold the end panel substantially perpendicular to the side panels, the top panel, and the bottom panel without the use of glue.

21. The carrier of claim 20 wherein the locking panel is positioned adjacent the bottom panel; the locking panel including apertures which are generally aligned with the bottom panel apertures when adjacent the bottom panel; whereby, when the carrier is applied to a set of bottles, the bottles will extend through the locking panel apertures and the bottom panel apertures.

22. The carrier of claim 1 wherein the top panel top ply aperture is off set from the center of the circle defined by the tab bases.

23. The carrier of claim 1 wherein the tab bases have a length, the length of the tabs surrounding a single aperture being varied.

24. A bottle carrier for transporting a plurality of bottles, the carrier including:

a top panel comprising a first ply and a second ply, the first and second plies each having a plurality of generally aligned apertures;

a pair of side panels depending from opposing sides of the top panel; and a bottom panel having a plurality of apertures therein, the bottom panel apertures being defined by edges; the bottom panel including tongues extending from an edge of the bottom panel aperture into the bottom panel aperture; the tongues engaging sides of bottles to be pivot upwardly about a base of the tongues when bottles are received in the carrier.

25. A bottle carrier for transporting a plurality of bottles, the carrier including:

a top panel comprising a first ply and a second ply, the first and second plies each having a plurality of generally aligned apertures;

a pair of side panels depending from opposing sides of the top panel; and a bottom panel having a plurality of apertures therein, the bottom panel apertures being defined by edges; the bottom panel including tongues extending from the bottom panel aperture edges; the tongues engaging sides of bottles when bottles are received in the carrier; the tongues having a fixed end about which the tongue bends, the tongue fixed end being separated from the edge of the aperture along a portion of the fixed end; the tongue fixed end being separated from the aperture by a notch, the notch defining a pair of legs which hold the tongue to the carrier bottom panel.

26. A bottle carrier for transporting a plurality of bottles, the carrier including:

a top panel comprising a first ply and a second ply, the first and second plies each having a plurality of generally aligned apertures;

a pair of side panels depending from opposing sides of the top panel; and a bottom panel having a plurality of apertures therein, the bottom panel apertures being defined by edges.

27. A bottle carrier for transporting a plurality of bottles, the carrier including:

a top panel comprising a first ply and a second ply, the first and second plies each having a plurality of generally aligned apertures;

a first side wall and a second side wall; each said side wall comprising at least an outer ply and an inner ply; and a bottom panel having a plurality of apertures therein; and a line of weakness extending substantially the full length of hinges between the top panel ply and the side wall inner plies;

wherein the carrier is formed from a blank in which the first side wall inner ply and the second side wall inner ply are hingedly connected to a top panel ply.

28. A bottle carrier for transporting a plurality of bottles, the carrier including a panel comprising a first ply and a second ply, the first and second plies each having a plurality of generally aligned apertures, the top ply apertures and bottom ply apertures each having an edge; a plurality of slits extending from the edge of the top ply apertures to define a set of tabs surrounding said aperture; said tabs having bases, said tab bases defining a diameter different than the diameter of the second ply apertures such that the tab bases are radially offset from the edge of the second ply apertures, the bases of the tabs being of different lengths to define tabs of varying width around an aperture.

29. A bottle carrier for transporting a plurality of bottles; the carrier comprising:

a top panel having a plurality of apertures, the top panel including a top ply and a bottom ply; the top panel apertures being defined by apertures in the top and bottom plies; the top ply including slits extending from an edge of the top ply apertures to define tabs; the tabs having bases defining a circle; the circle defined by the tab bases having a diameter which is different from the diameter of the bottom ply apertures;

a pair of side panels, the side panels having at least an inner ply and an outer ply;

a bottom panel extending between the side panels; the bottom panel having a plurality of apertures;

at least one end panel which closes an open end of the carrier; the end panel having a locking panel hingedly connected thereto; the locking panel including apertures positioned to be aligned with the bottom panel apertures when the carrier is applied to a group of bottles; and a tongue extending from an edge of the bottom ply aperture.

30. The carrier of claim 25 wherein the tongue takes on a curvature which approximates the curvature of the bottom panel aperture when the carrier is applied to bottles.

31. The carrier of claim 25 wherein the tongue has a line of weakness extending at least partially along the tongue.

32. The carrier of claim 24 wherein the tongue base is separated from the edge of the aperture along a portion of the tongue base.

33. The carrier of claim 26 wherein the locking panel is positioned adjacent the bottom panel; the locking panel including apertures which are generally aligned with the bottom panel apertures when adjacent the bottom panel; whereby, when the carrier is applied to a set of bottles, the bottles will extend through the locking panel apertures and the bottom panel apertures.

34. The carrier of claim 27, wherein the line of weakness is one of a series of slits, slots, or perforations.

35. The carrier of claim 27 wherein the line of weakness covers at least 90% of the hinge line between the side wall inner ply and the top panel.

36. The carrier of claim 35 wherein the line of weakness is formed such that when the carrier is formed from the blank, one side wall inner ply will separate from the top panel ply to which it is connected.

37. The carrier of claim 27 including a further line of weakness along the hinge line between one of the side wall outer plies and the top panel ply to which the one side wall out ply is connected.

38. The carrier of claim 28 wherein each said tab has a base; said tab bases defining an ellipse around the aperture; the center of the aperture being offset from the center of the ellipse.

39. The carrier of claim 38 wherein the ellipse is a circle.

* * * * *